US010171905B2

(12) United States Patent
Wen et al.

(10) Patent No.: US 10,171,905 B2
(45) Date of Patent: Jan. 1, 2019

(54) HEADPHONES WITH FREQUENCY-TARGETED RESONANCE CHAMBERS

(71) Applicants: Tseng Feng Wen, Taoyuan (TW); Jing Luen Wen, Taoyuan (TW); Hsin Hao Wen, Taoyuan (TW)

(72) Inventors: Tseng Feng Wen, Taoyuan (TW); Jing Luen Wen, Taoyuan (TW); Hsin Hao Wen, Taoyuan (TW)

(73) Assignee: TRANSOUND ELECTRONICS CO., LTD., Guangdong (CN)

( * ) Notice: Subject to any disclaimer, the term of this patent is extended or adjusted under 35 U.S.C. 154(b) by 0 days.

(21) Appl. No.: 16/020,892

(22) Filed: Jun. 27, 2018

(65) Prior Publication Data

US 2018/0310090 A1 Oct. 25, 2018

Related U.S. Application Data

(63) Continuation-in-part of application No. 15/426,991, filed on Feb. 7, 2017, now abandoned.

(30) Foreign Application Priority Data

Feb. 14, 2016 (CN) ..... 2016 1 0084625
Jul. 15, 2016 (CN) ..... 2016 2 0746414 U

(51) Int. Cl.

| | |
|---|---|
| ***H04R 1/02*** | (2006.01) |
| ***H04R 1/10*** | (2006.01) |
| ***H04R 1/28*** | (2006.01) |
| ***H04R 5/033*** | (2006.01) |

(52) U.S. Cl.
CPC ..... *H04R 1/1075* (2013.01); *H04R 1/1008* (2013.01); *H04R 1/2811* (2013.01); *H04R 5/033* (2013.01); *H04R 2201/10* (2013.01); *H04R 2201/105* (2013.01)

(58) Field of Classification Search
CPC .. H04R 1/1008; H04R 1/1075; H04R 1/2819; H04R 1/2849; H04R 1/2888; H04R 9/06; H04R 2201/105; H04M 1/1035
USPC ..... 381/345, 349, 350, 351, 353, 354, 370, 381/371, 372, 373, 380; 181/128, 129, 181/135, 160; 379/433.02, 432
See application file for complete search history.

(56) References Cited

U.S. PATENT DOCUMENTS 3,246,721 A * 4/1966 Martin ..... H04R 1/225 181/160
4,239,945 A * 12/1980 Atoji ..... H04R 1/2819 381/349
4,742,887 A * 5/1988 Yamagishi ..... H04R 1/2857 181/129
9,602,912 B2 * 3/2017 Wen ..... H04R 1/24

* cited by examiner

*Primary Examiner* — Huyen D Le
(74) *Attorney, Agent, or Firm* — Law Offices of S.J. Christine Yang

(57) ABSTRACT

The present invention is directed to a headphone device including zones to separate different frequency ranges for enhancing and improving sound quality. The headphone device includes more than one cavities and second auxiliary holes. The second auxiliary holes are configured for most bass or low-frequency to enter a second cavity through the second auxiliary holes and to have a better frequency division effect and to improve the audio quality of the headphone device.

14 Claims, 18 Drawing Sheets

10

HEADPHONES WITH FREQUENCY-TARGETED RESONANCE CHAMBERS

The present application is a continuation-in-part application of U.S. patent application Ser. No. 15/426,991, filed on Feb. 7, 2017, The present application claims priority to Chinese Patent Application No. 201610084625.X, filed Feb. 14, 2016, and Chinese Patent Application No. 201620746414.3, filed Jul. 15, 2016, the disclosures of which are incorporated herein by reference in their entireties.

BACKGROUND OF THE INVENTION

Field of the Invention

The present invention relates generally to headphones and methods for providing sound enhancement thereof, and, more specifically, to headphones with resonance chambers configured for different frequency ranges and to provide enhanced sound effects, while maintaining a thin or compact profile of the headphones.

Discussion of the Related Art

A conventional headphone comprises an earphone casing and a sounding module mounted in the earphone casing. The sounding module comprises a main body and a loudspeaker assembly mounted in the main body. The earphone casing has a front cavity corresponding to the front side of the sounding module and a rear cavity corresponding to the rear side of the sounding module. The main body has a baseboard portion and an annular portion connected to each other. The front cavity is formed and surrounded by the baseboard portion and the annular portion. The baseboard portion is formed with a through-hole in communication with the front cavity and the rear cavity. The loudspeaker assembly comprises a yoke, a magnet, a washer, a voice coil, and a diaphragm. The yoke, the magnet, the washer, and the voice coil are mounted corresponding to the through hole.

The cavity structure of the headphone will directly impact on the audio performance of the headphone. However, in the existing technique, the cavity structure of the headphone limits the headphone to improve the audios quality. It is difficult to meet the requirements for the audios quality of the headphone. For instance, all the low-frequency signals, intermediate-frequency signals and high-frequency signals of the sounding module are mixed in the rear cavity in the existing technique. The frequency division effect is not good. In particular, the high-frequency signals can't be separated clearly to impact on the bass effect. As a result, the audios quality of the headphone is not good. It is difficult to meet the higher and high requirements for the audios quality of the headphone.

Accordingly, the inventor of the present invention has devoted himself based on his many years of practical experiences to solve this problem.

SUMMARY OF THE INVENTION

Accordingly, embodiments of the invention are directed to headphones that substantially obviate one or more of the problems due to limitations and disadvantages of the related art.

An object of embodiments of the invention is to provide headphones for most low frequency to enter a rear cavity through auxiliary holes and for the headphone to have a better frequency division effect and improves the audio quality of the headphone.

Another object of embodiments of the invention is to provide a headphone module with an improved tri-frequency balance. To accomplish frequency division of low-frequency signals, the headphone module is provided with first auxiliary air holes in front of second auxiliary air holes to retain and enhance intermediate-frequency signals effectively, in particular high-frequency signals, to adjust and improve tri-frequency balance and to improve the audio quality of the headphone.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, a headphone includes a housing, the housing including a first chamber, a second chamber, a first through-hole, wherein the first chamber and the second chamber are separated by a first wall, and the first through-hole is in the first wall; a loudspeaker assembly in the housing, the loudspeaker assembly including a yoke, a magnet, a washer, a voice coil, and a diaphragm, wherein the yoke, the magnet, the washer, and the voice coil are positioned corresponding to the first through-hole, the diaphragm being connected on the voice coil in the first chamber; a first annular portion in the housing, wherein the first annular portion including a first auxiliary hole and a second auxiliary hole, each of the first auxiliary hole and the second auxiliary hole overlapping a portion of the first through-hole, wherein the first auxiliary hole is covered with a first sound-proof material and the second auxiliary hole is covered with a second sound-proof material and wherein the first sound-proof material filters a first frequency range and the second sound-proof material filters a second frequency range, the first frequency range being substantially different from the second frequency range.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Reference will now be made in detail to the preferred embodiments of the invention, examples of which are illustrated in the accompanying drawings.

Figure 1:
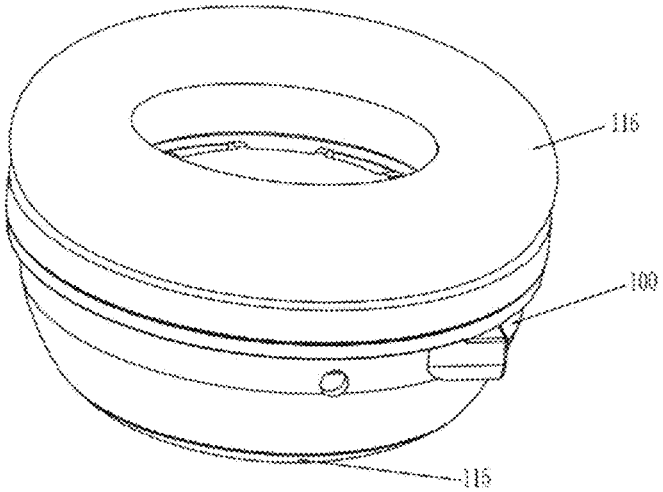
FIG. 1 is a perspective view illustrating a headphone in accordance with an embodiment of the present invention.
Figure 2:
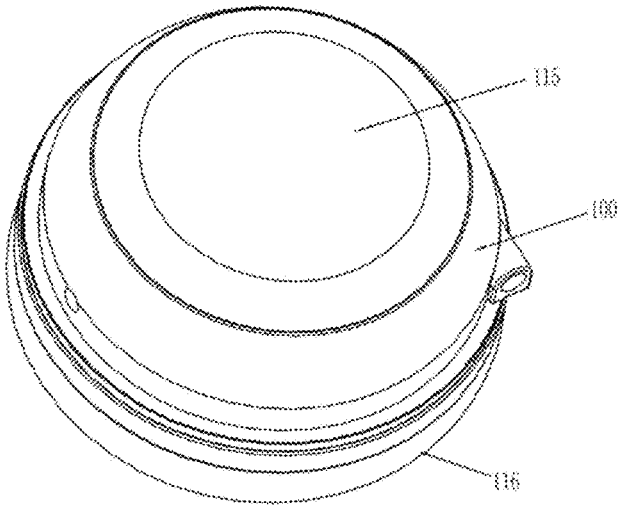
FIG. 2 is another perspective view illustrating a headphone in accordance with an embodiment of the present invention.

FIG. 1 is a perspective view of a headphone in accordance with an embodiment of the present invention and FIG. 2 is another perspective view of a headphone in accordance with an embodiment of the present invention. As illustrated in FIG. 1 and FIG. 2, a headphone includes an earphone casing 100. The front end of the earphone casing 100 is provided with a rear end cover 115 and an earmuff 116.

Figure 3:
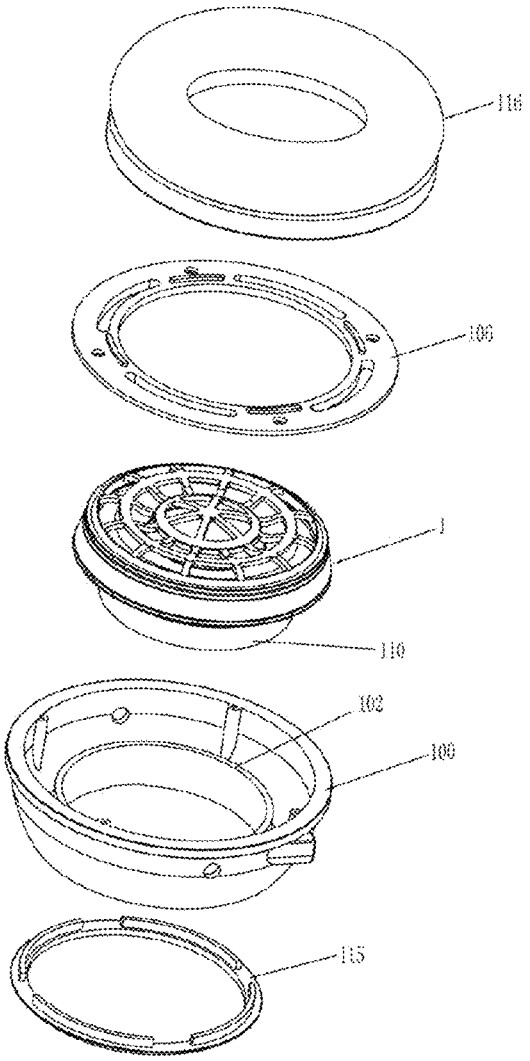
FIG. 3 is an exploded view illustrating a headphone in accordance with an embodiment of the present invention.
Figure 4:
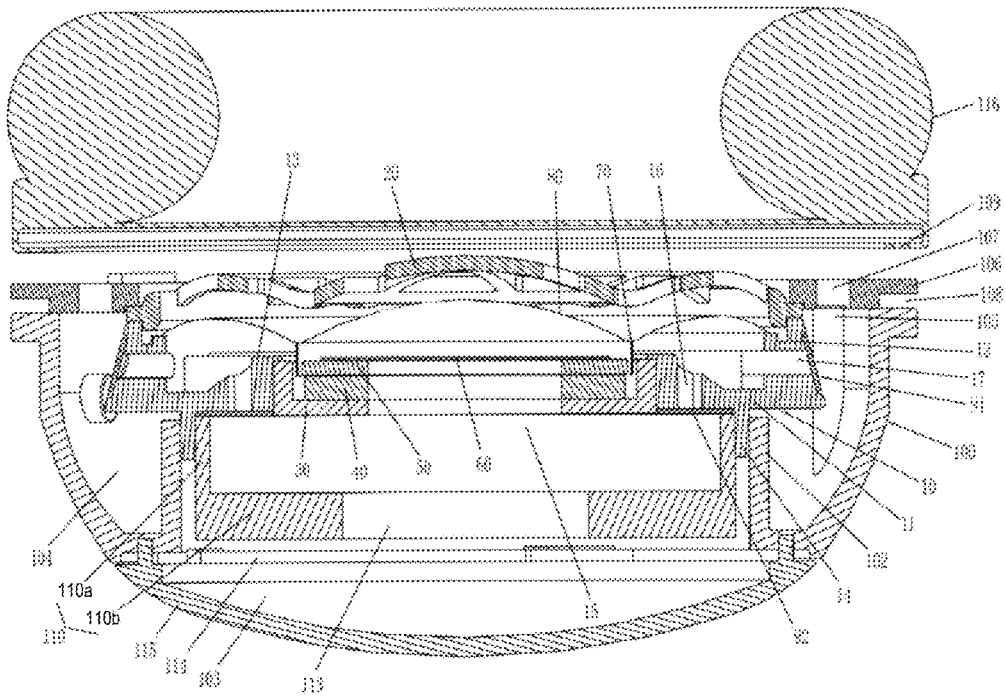
FIG. 4 is a sectional view illustrating a headphone in accordance with an embodiment of the present invention (the earmuff and the headphone are separate)
Figure 5:
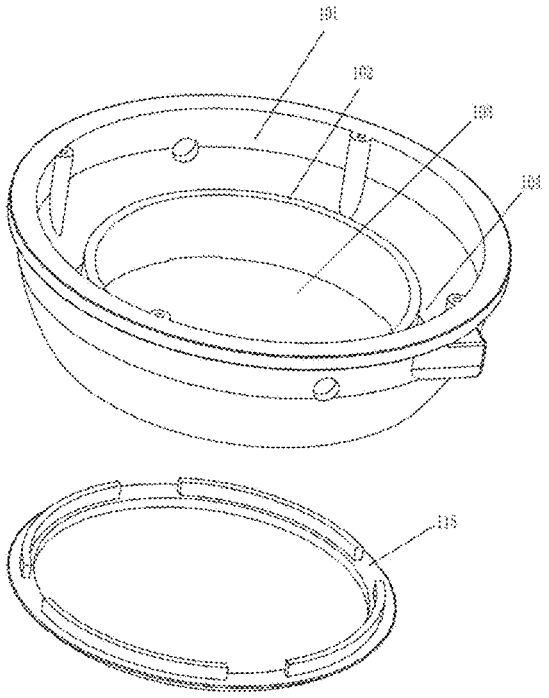
FIG. 5 is an exploded view illustrating the earphone casing and the ear end cover in accordance with an embodiment of the present invention.
Figure 6:
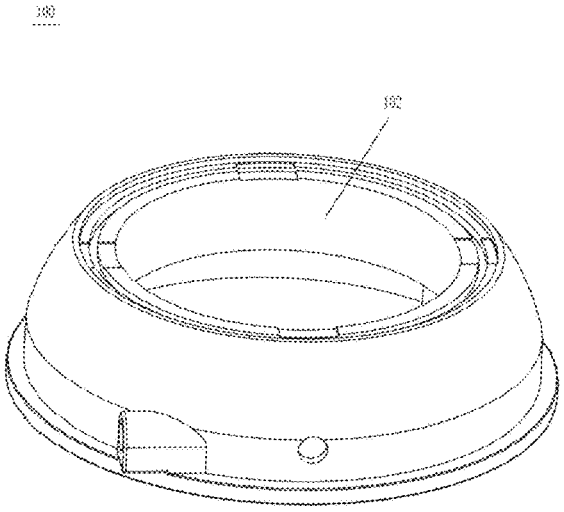
FIG. 6 is a perspective view illustrating the headphone casing in accordance with an embodiment of the present invention.
Figure 7:
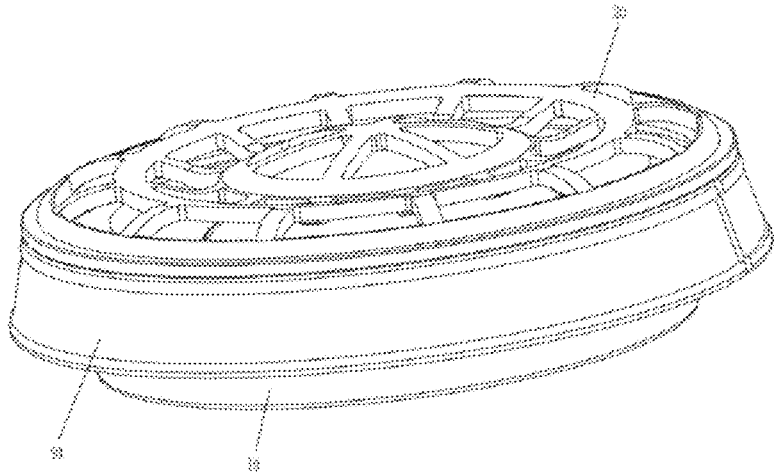
FIG. 7 is a perspective view illustrating the sounding module in accordance with an embodiment of the present invention.
Figure 8:
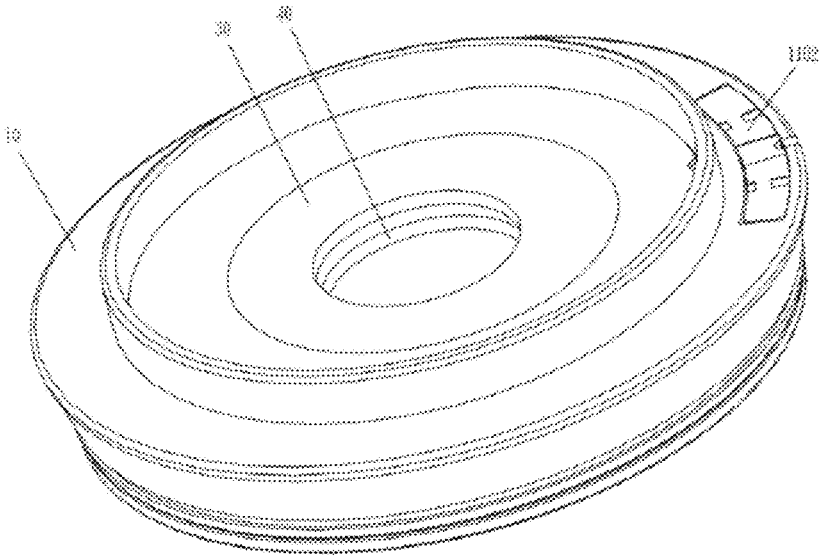
FIG. 8 is another perspective view illustrating the sounding module seen from a different angle in accordance with an embodiment of the present invention.
Figure 9:
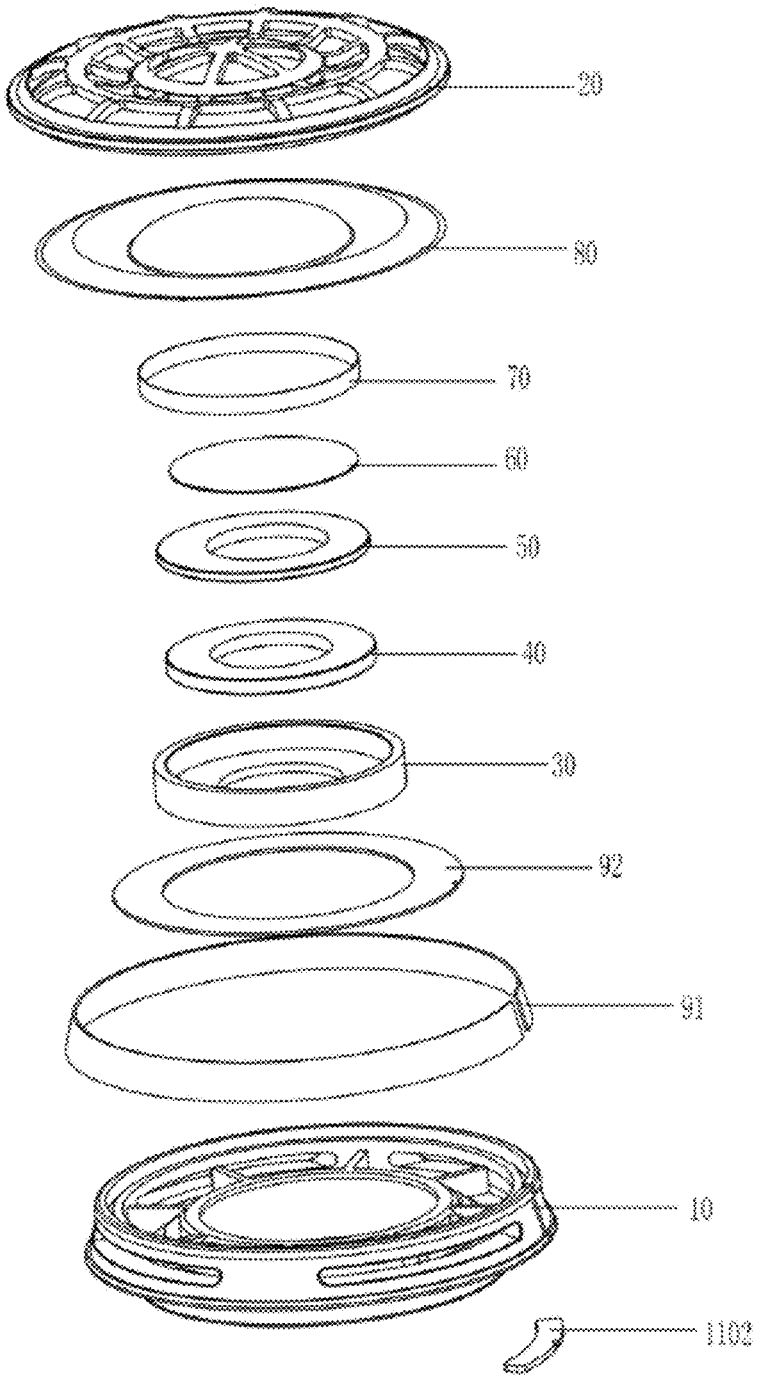
FIG. 9 is an exploded view illustrating the sounding module in accordance with an embodiment of the present invention.
Figure 10:
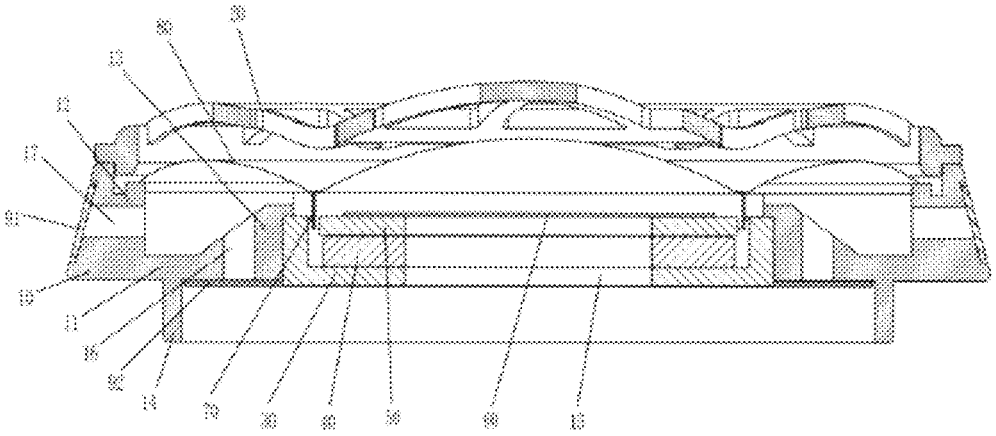
FIG. 10 is a sectional view illustrating the sounding module in accordance with an embodiment of the present invention.
Figure 11:
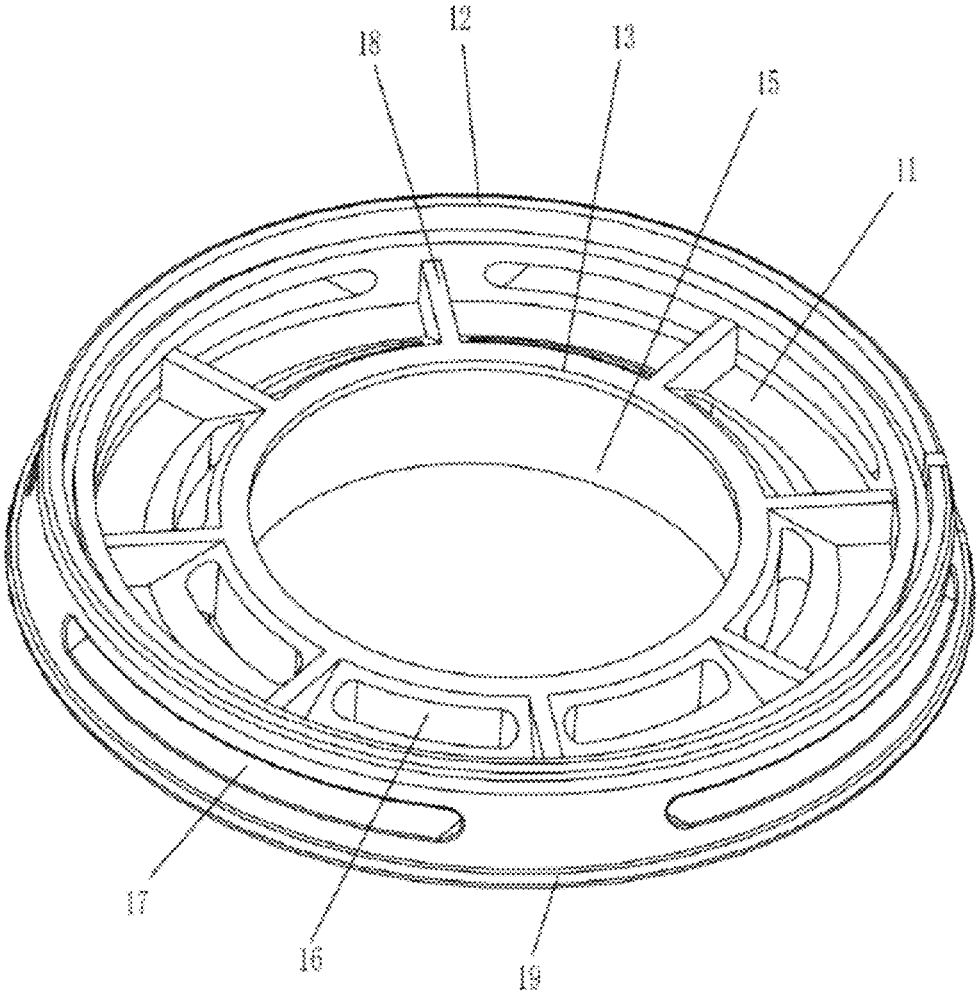
FIG. 11 is a perspective view illustrating a headphone main body in accordance with an embodiment of the present invention.
Figure 12:
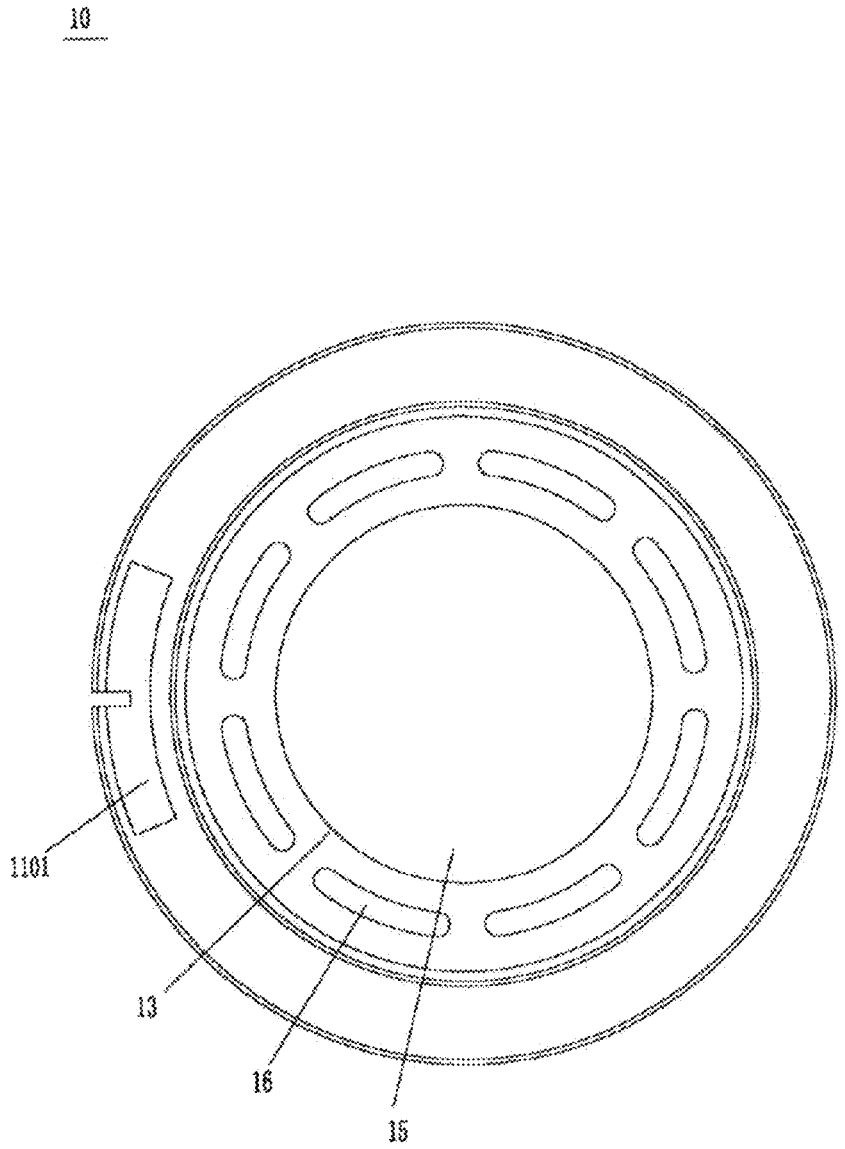
FIG. 12 is a front view illustrating a headphone main body in accordance with an embodiment of the present invention.
Figure 13:
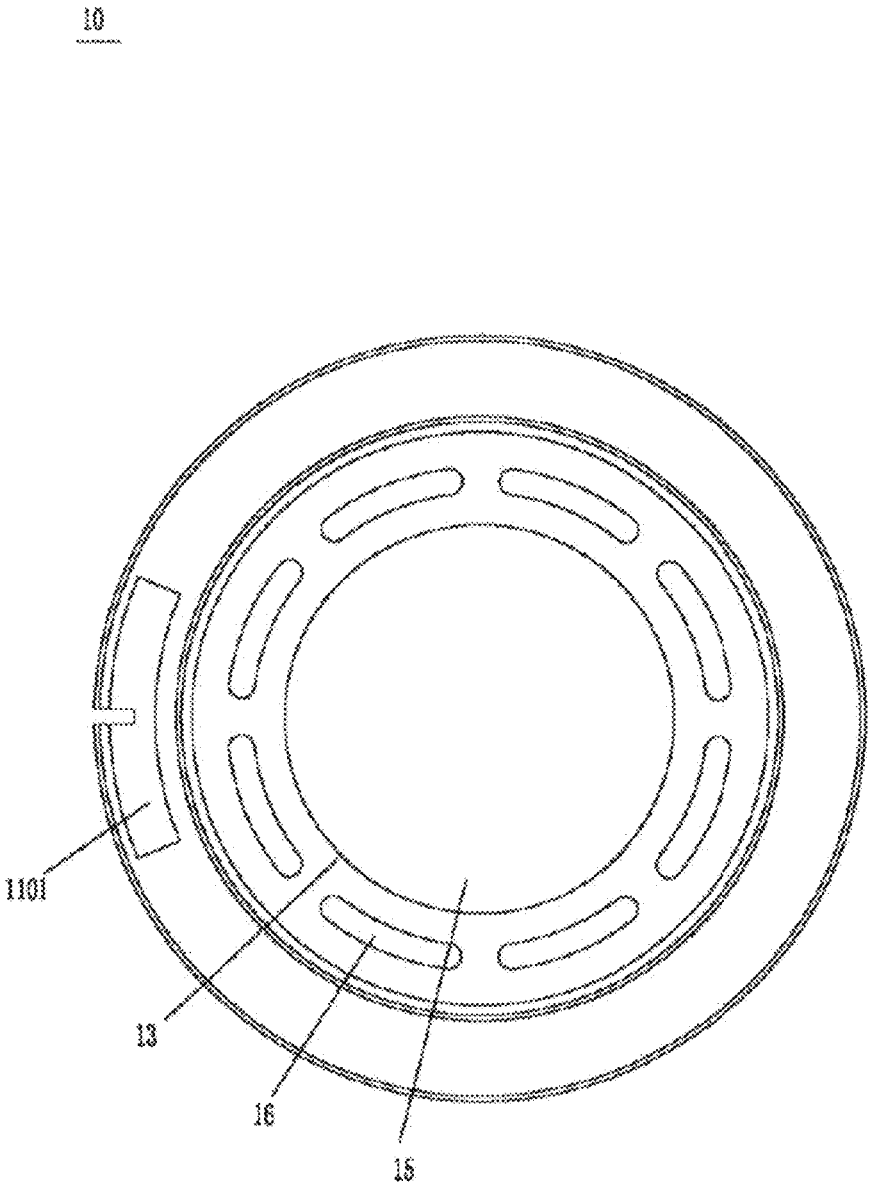
FIG. 13 is a rear view illustrating a headphone main body in accordance with an embodiment of the present invention.
Figure 14:
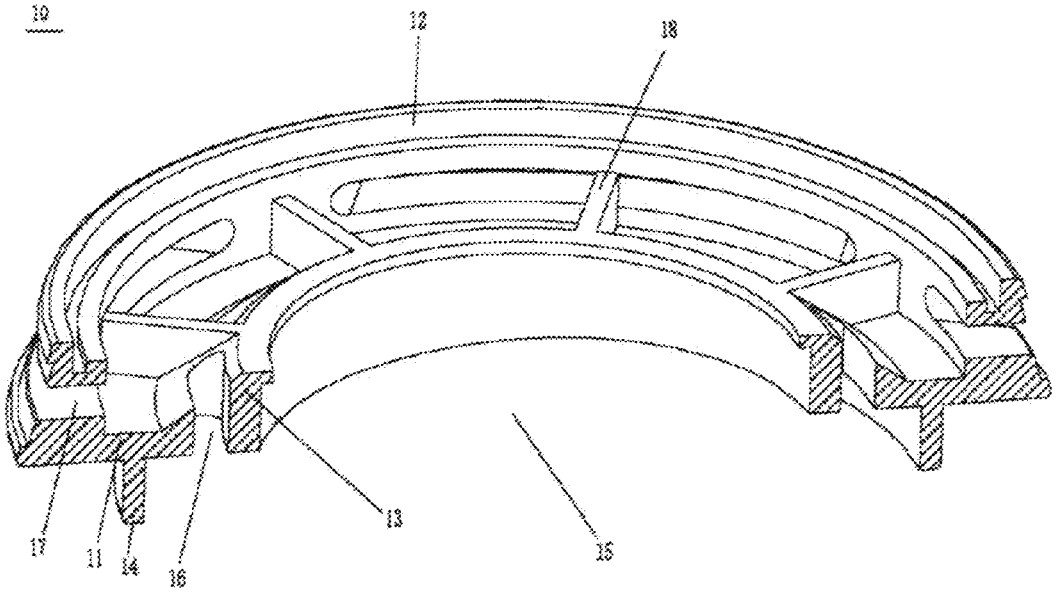
FIG. 14 is a perspective sectional view illustrating a headphone main body in accordance with an embodiment of the present invention.

FIG. 3 is an exploded view of a headphone in accordance with an embodiment of the present invention, and FIG. 4 is a sectional view of a headphone in accordance with an embodiment of the present invention (the earmuff and the headphone are separate). As illustrated in FIG. 3 and FIG. 4, the earphone casing 100 has an accommodation room 101. The accommodation room 101 has a front-end opening at the front end of the earphone casing 100. The rear end of the accommodation room 101 is provided with an annular partition 102. The exterior of the annular partition 102 is formed with a first rear cavity 103. A second rear cavity 104 is formed between the exterior of the annular partition 102 and the inner wall of the earphone casing 100. The first rear cavity 103 penetrates the rear end of the earphone casing 100. The rear end of the earphone casing 100 is formed with a rear end opening 114. The rear end opening 114 is provided with a rear end cover 115.

The sounding module 1 comprises a main body 10 and a loudspeaker assembly mounted in the main body 10.

The main body 10 includes a baseboard portion 11 and a first annular portion 12 connected to each other. The rear end face of the baseboard portion 11 of the main body 10 is formed with an installation rough 1101. The installation trough 1101 is 25 provided with a printed circuit board 1102 therein. The baseboard portion 11 and the first annular portion 12 jointly define a front cavity surrounded therebetween. The baseboard portion 11 is formed with a through-hole 15 penetrating two sides of the baseboard portion 11 and the front cavity.

The loudspeaker assembly comprises a yoke 30, a magnet 40, a washer 50, a piece of circular soundproof 60, a voice coil 70, 30 and a diaphragm 80. The yoke 30, the magnet 40, the washer 50, and the voice coil 70 are mounted corresponding to the through-hole 15. The diaphragm 80 is connected on the voice coil 70 and located in the front cavity. The front end of the first annular portion 12 is mounted with an upper cover 20. The upper cover 20 is formed with a plurality of sound holes. The loudspeaker assembly is covered by the upper cover 20 to be inside the main body 10.

The baseboard portion 11 is further formed with more than one first auxiliary air hole 16. The first auxiliary air holes 16 are located beside the through-hole 15 and corresponding to the outer side of the voice coil 70. The first annular portion 12 is formed with more than one second auxiliary air hole 17 communicating with the outside. The first auxiliary air holes 16 and the second auxiliary air holes 17 are covered with a piece of soundproof paper, respectively. The outer side of the first annular portion 12 is formed with an annular recess 19 corresponding to the second auxiliary air holes 17. The piece of soundproof paper corresponding to the second auxiliary air holes 17 is designed to be a piece of an integral curved soundproof paper 91. The piece of integral curved soundproof paper 91 is disposed in the annular recess 19. The piece of soundproof paper corresponding to the first auxiliary air holes 16 is designed to be a piece of integral annular soundproof paper 92. The piece of integral annular soundproof paper 92 is to cover all the first auxiliary air holes 16.

The sounding module 1 is installed in the accommodation room 101. The main body 10 is disposed on top of the annular partition 102. The through-hole 15 is aligned with the first rear cavity 103 inside the annular partition 102. The second auxiliary air holes 17 are in communication with the second rear cavity 104. The annular partition 102 is located between the first auxiliary air holes 16 and the second auxiliary air holes 17. A frequency division cavity is formed among the outer side of the main body 10, the annular partition 102, and the inner wall of the earphone casing 100.

The frequency division cavity is formed with a third auxiliary air hole 105 at the front-end opening of the earphone casing 100.

An annular stop board 106 is provided in front of the third auxiliary air hole 106. The annular stop board 106 is formed with more than one fourth auxiliary air hole 107 in communication with the third auxiliary air hole 105 and the frequency-division cavity. The fourth auxiliary air holes 107 are also covered with a piece of soundproof paper. The front end of the earphone casing 100 is provided with an earmuff 116. The earmuff 116 is connected to the annular stop board 106. The annular stop board 106 is locked to the front end of the earphone casing 100. The sounding module 1 is pressed and confined between the annular stop board 106 and the annular partition 102. The outer side of the annular stop board 106 is formed with a buckle groove 108. The rear end of the earmuff 116 is formed with an elastic buckle portion 109. The elastic buckle portion 109 is engaged in the buckle groove 108.

The front and rear end faces of the baseboard portion 11 are provided with a second annular portion 13 and a third annular portion 14, respectively. The through-hole 15 penetrates the interiors of the second annular portion 13 and the third annular portion 14. The first auxiliary air holes 16 penetrate the exterior of the second annular portion 13 and the interior of the third annular portion 14. A plurality of reinforcement ribs 18 are provided and connected between the second annular portion 13 and the baseboard portion 11. Each of the first auxiliary holes 16 is disposed between every adjacent two of the reinforcement ribs 18. The first auxiliary holes 16 and the second auxiliary holes 17 are arranged annularly, which can be arranged in other forms, not limited thereto. Between the outer side of the second annular portion 13 and the front-end face of the baseboard portion 11 is a frustum configuration, which is gradually enlarged from front to back. The first auxiliary holes 16 are disposed on the frustum configuration. The third annular portion 14 extends into the annular partition 102. A soundproof sleeve 110 is provided beneath the baseboard portion 11 corresponding to the third annular portion 14. The soundproof sleeve 110 has a sleeve body portion 110*a* and an inner stop portion 110*b* integrally connected to the lower end of the sleeve body portion 110*a*. The inner stop portion 110*b* is formed with a voice convergence hole 113 corresponding in position to the through-hole 15. The sleeve body portion 110*a* extends rearward beyond the rear end of the annular partition 102.

Figure 15:
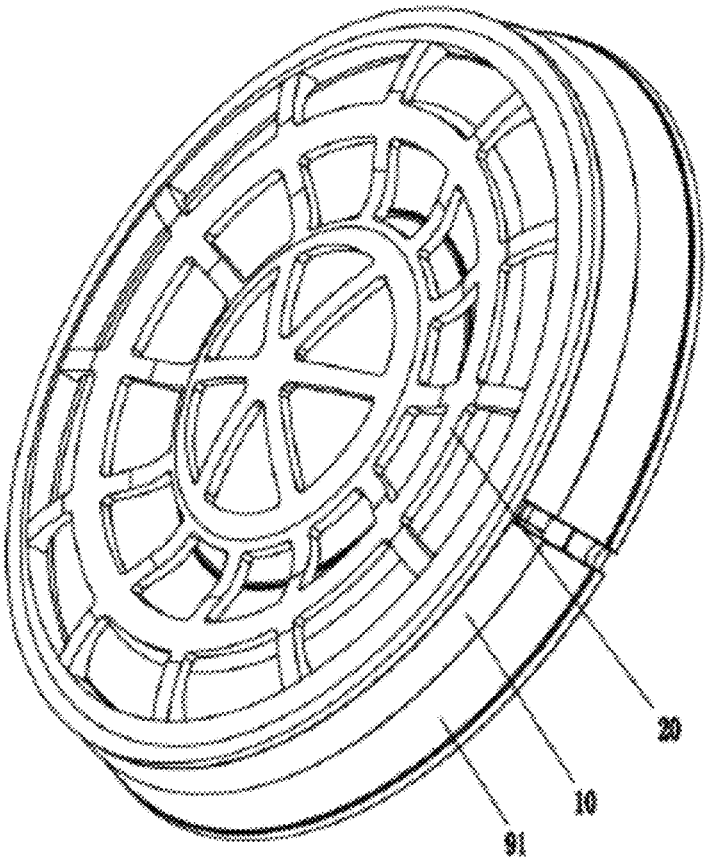
FIG. 15 is a perspective view illustrating a headphone module in accordance with an embodiment of the present invention.
Figure 16:
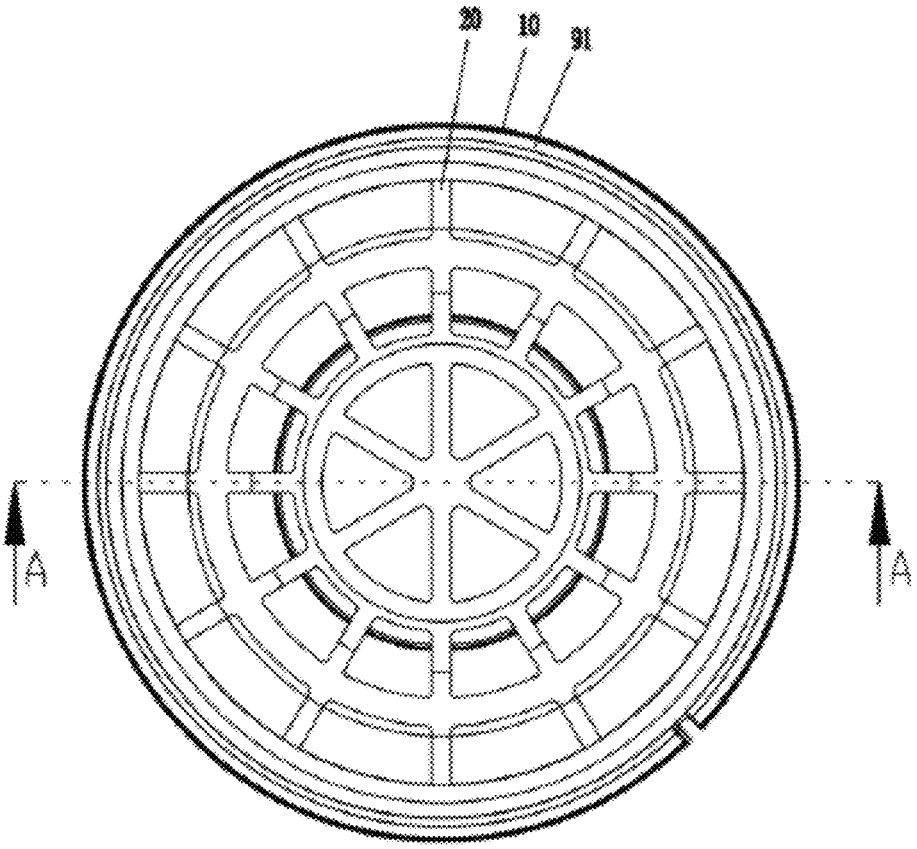
FIG. 16 is another perspective view illustrating a headphone module in accordance with an embodiment of the present invention.

FIG. 15 is a perspective view of a headphone module in accordance with an embodiment of the present invention, and FIG. 16 is another perspective view of a headphone module in accordance with an embodiment of the present invention. As illustrated in FIG. 15 and FIG. 16, the headphone module comprises a main body 10 and upper cover 20. The upper cover 20 is formed with a plurality of sound holes. The headphone module according to an embodiment of the present invention can be applied to different headphone products.

Figure 17:
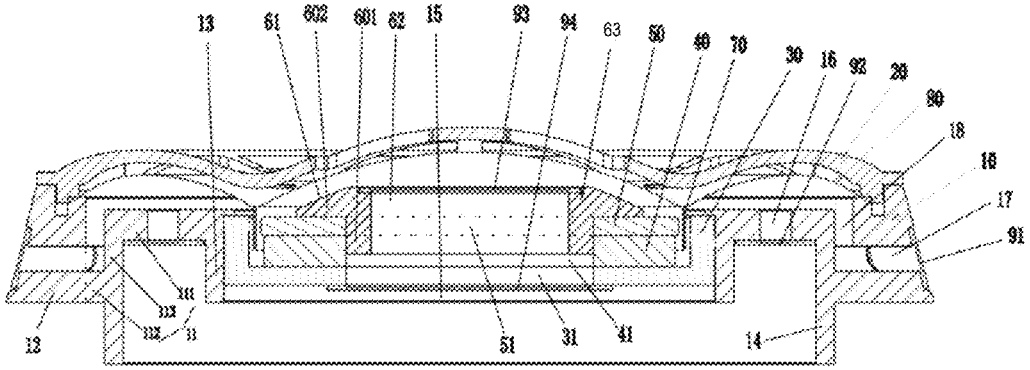
FIG. 17 is a sectional view taken along line A-A of FIG. 16.
Figure 18:
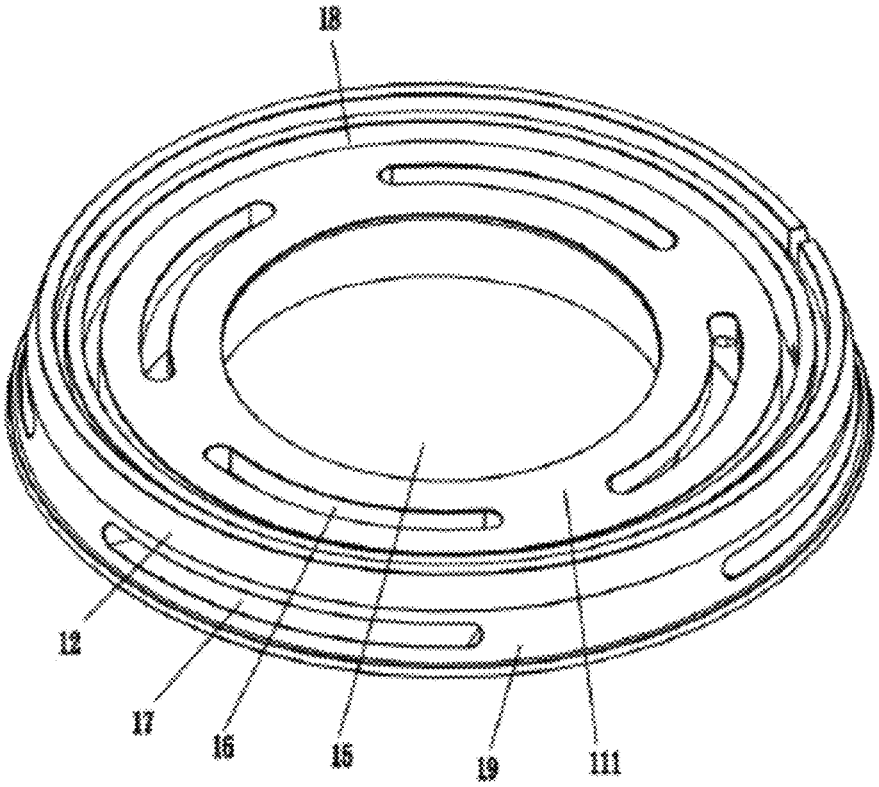
FIG. 18 is a perspective view illustrating a headphone main body in accordance with an embodiment of the present invention.

FIG. 17 is a sectional view taken along line A-A of FIG. 16, and FIG. 18 is a perspective view of a headphone main body in accordance with an embodiment of the present invention. As illustrated in FIG. 17 and FIG. 18, the headphone module also includes a loudspeaker 10 assembly mounted in the main body 10. The main body 10 has a baseboard portion 11 and a first annular portion 12 connected to each other. The baseboard portion 11 and the first annular portion 12 jointly define a front cavity surrounded therebetween. The front end of the first annular portion 12 is mounted with an upper cover 20. The upper cover 20 is formed with a plurality of sound holes. The loudspeaker assembly is covered by the upper cover 20 and is to be inside the main body 10. The baseboard portion 11 is formed with a first through-hole 15 penetrating the front and rear sides of the baseboard portion 11 and the front cavity. The loudspeaker assembly comprises a yoke 30, a magnet 40, a washer 50, a voice coil 70, and a diaphragm 80. The yoke 30, the magnet 40, the washer 50, and the voice coil 70 are mounted corresponding to the first through-hole 15. The diaphragm 80 is connected on the voice coil 70 and located in the front cavity.

The baseboard portion 11 is further formed with more than one first auxiliary air hole 16 penetrating the front and rear sides of the baseboard 11. The first auxiliary air holes 16 are located beside the first through-hole 15 and corresponding to the outer side of the voice coil 70. The first annular portion 12 is formed with more than one second auxiliary air hole 17 penetrating the front cavity to communicate with the outside. The second auxiliary air holes 17 are located behind the first auxiliary air holes 16 in the anterior-posterior direction. This design can prevent much airflow from flowing out from the second auxiliary air holes 17 to cause a loss of high-frequency signals. Thus, on the premise to accomplish frequency division of low-frequency signals, this can retain and enhance intermediate-frequency signals effectively, in particular high-frequency signals so as to adjust and improve tri-frequency balance. The first auxiliary air holes 16 and the second auxiliary air holes 17 are covered with soundproof paper, respectively. The outer side of the first annular portion 12 is formed with an annular recess 19 corresponding to the second auxiliary air holes 17. The soundproof paper corresponding to the second auxiliary air holes 17 is designed to be integral curved soundproof paper 91. The integral curved soundproof paper 91 is disposed in the annular recess 19. The soundproof paper corresponding to the first auxiliary air holes 16 is designed to be integral annular soundproof paper 92. The integral annular soundproof paper 92 is to cover all the first auxiliary air holes 16. In general, the curved soundproof paper 91 is more sparse in material than the annular soundproof paper 92.

Figure 19:
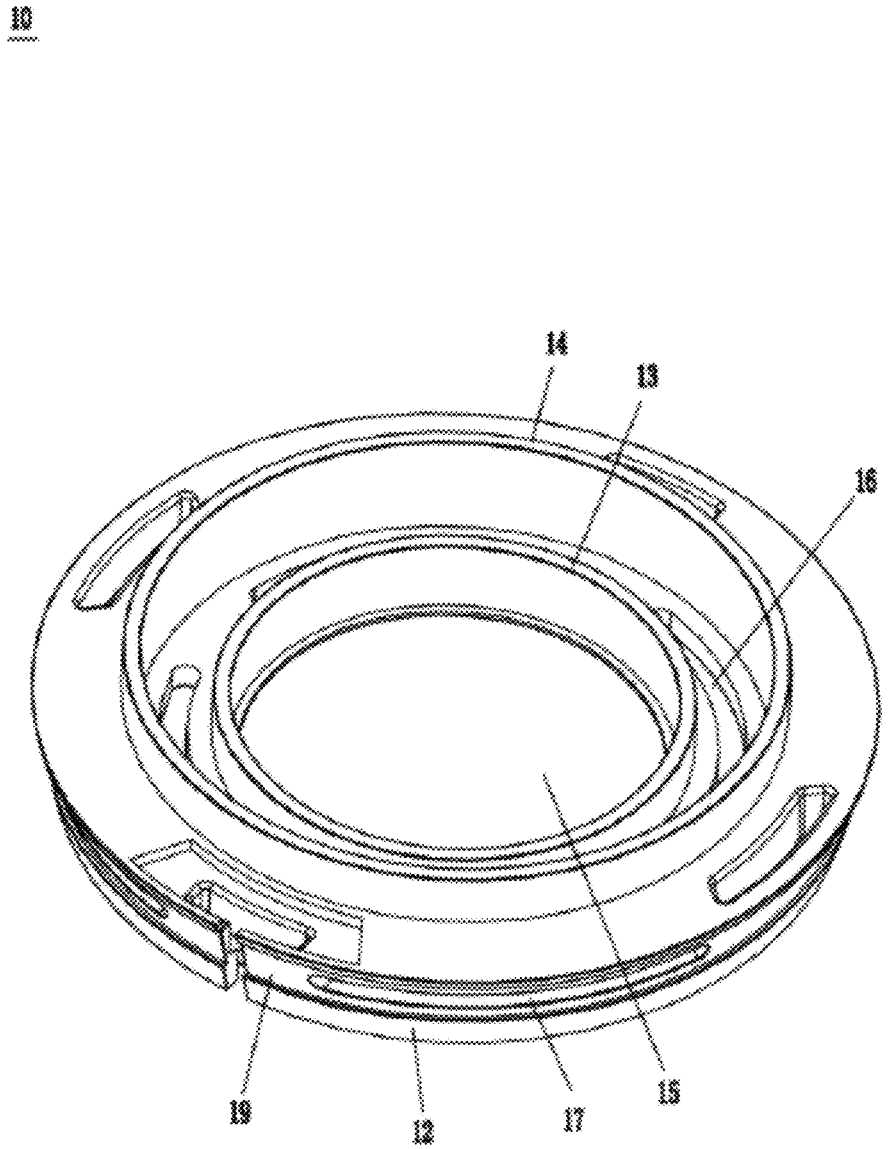
FIG. 19 is another perspective view illustrating a headphone main body in accordance with an embodiment of the present invention.
Figure 20:
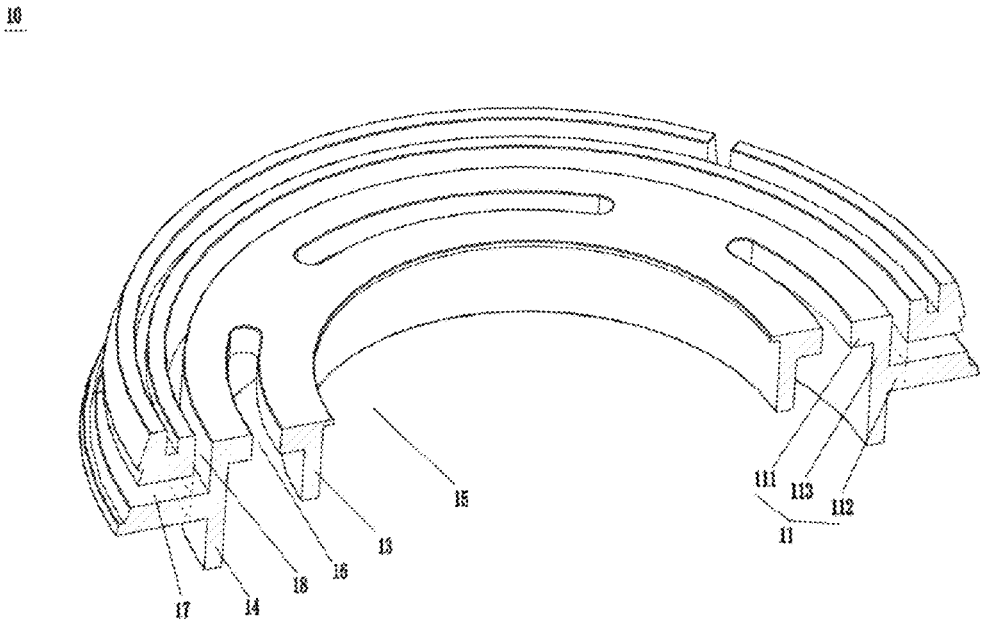
FIG. 20 is a perspective sectional view illustrating a headphone main body in accordance with an embodiment of the present invention.

As shown in FIG. 18 to FIG. 20, the baseboard portion 11 has a first baseboard portion 111, a second baseboard portion 112, and a connecting portion 113. The first baseboard portion 111 is connected to a front end of the connecting portion 113. The second baseboard portion 112 is connected to a rear end of the connecting portion 113. The first through-hole 15 and the first auxiliary air holes 16 are formed on the first baseboard portion 111. The first annular portion 12 is connected to the second baseboard portion 112. A transition passage 18 is formed between the connecting portion 113 and the first annular portion 12 to communicate with the front cavity and the second auxiliary air holes 17. The second auxiliary air holes 17 are vertically connected with the transition passage 18. The second auxiliary air holes 17 may be obliquely connected with the transition passage 18, or by means of other non-vertical connection relationships, not limited thereto. A rear end face of the first baseboard portion 111 is provided with a second annular portion 13 and a third annular portion 14. The first through-hole 15 penetrates the interior of the second annular portion 13. The first auxiliary air holes 16 correspond in position to the exterior of the second annular portion 13. The first auxiliary air holes 16 and the second annular portion 13 correspond in position to the interior of the third annular portion 14.

As shown in FIG. 19, an audio cavity adjustment member 63 is provided in front of the washer 50. The diaphragm 80 has a bass portion, an alto portion, and a soprano portion. The audio cavity adjustment member 63 is disposed toward the soprano portion of the diaphragm 80. The audio cavity adjustment member 63 enables the soprano portion to keep a constant distance apart from the rear end face of the front cavity, which ensures that the diaphragm 80 has better transient characteristics. The audio cavity adjustment member 63 has a conical surface 61 disposed toward the soprano portion of the diaphragm 80. The conical surface 61 extends from the periphery of the audio cavity adjustment member 63 toward the center of the audio cavity adjustment member 63 and gradually inclines forward or curves forward. The conical surface 61 is formed with the first through-hole 15 and a second through-hole 62 of the front cavity. The second through-hole 62 is covered with front circular soundproof paper 93. The yoke 30 is formed with a third through-hole 31 corresponding in position to the second through-hole 62. The third through-hole 31 is covered with rear circular soundproof paper 94. The magnet 40 and the washer 50 are formed with a fourth through-hole 41 and a fifth through-hole 51 respectively corresponding to the third through-hole 31. The audio cavity adjustment member 63 has an insertion portion 601 and a covering portion 602. The insertion portion 601 is inserted into the fifth through-hole 51 and the fourth through-hole 41. The covering portion 602 is located at the front side of the washer 50. The rear end face of the covering portion 602 is in contact with the front-end face of the washer 50. The conical surface 61 is the front surface of the covering portion 602.

Figure 21:
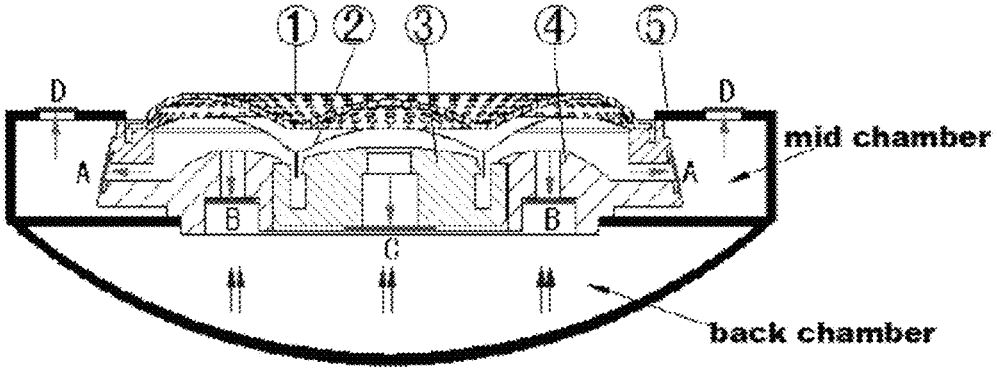
FIG. 21 is a cross-sectional illustration of sound flow and division of a headphone in accordance with an embodiment of the present invention.

FIG. 21 is a cross-sectional illustration of sound flow and division of a headphone in accordance with an embodiment of the present invention. As shown in FIG. 21, a headphone includes a loudspeaker assembly ① and multiple sound chambers. The loudspeaker assembly ① generates sound by a diaphragm ② and a magnet ③. The sound chambers are between a baseboard portion ④ and an earphone casing ⑤. The generated sound travels through first through-holes A, second through-holes B, and a third through-hole C. The first through-holes A are arranged annularly along a baseboard portion ④. The second through-holes B are arranged along circumference portion of the baseboard portion ④. The third through-hole C is in the center of the magnet ③.

A portion of the generated sound would pass through the first through-holes A and enter into the mid chamber of the headphone. Another portion of the generated sound would pass through the second through-holes B and enter into the back chamber of the headphone. Another portion of the generated sound would pass through the third through-holes C and enter into the back chamber of the headphone.

Each of the first through-holes A, the second through-holes B, and the third through-hole C is covered by different sound filtering materials. The material of the inner walls of the mid chamber is selected to resonate a certain sound frequency range. Also, the material of the inner walls of the back chamber is selected to resonate another certain sound frequency range. The back chamber provides a resonance zone for a frequency range different from the mid chamber.

Figure 22:
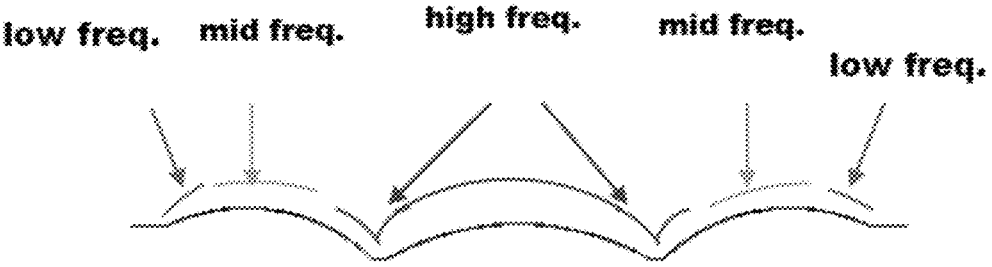
FIG. 22 is an illustration of sound frequency distributions across a headphone main body in accordance with an embodiment of the present invention.

FIG. 22 is an illustration of sound frequency distributions across a headphone main body in accordance with an embodiment of the present invention. As illustrated in FIG. 22, a headphone includes multiple sound chambers. With the selection and combination of through-hole locations, chamber wall materials, and the sound filtering materials on the through-holes, sound chambers resonate different frequency ranges. The headphone concentrates sound with high frequency in a center portion. The headphone also distributes sound with mid frequency in a middle ring portion. The headphone disperses sound with low frequency in a outer ring portion.

The headphone module according to an embodiment of the present invention includes with the first and second auxiliary air holes. The second auxiliary air holes accomplish frequency division of low-frequency signals. The first auxiliary air holes are disposed in front of the second auxiliary air holes to retain and enhance intermediate-frequency signals effectively, in particular high-frequency signals, so as to adjust and improve tri-frequency balance and to improve the audio quality of the earphone. The headphone module according to an embodiment of the present invention is beneficial for production and assembly. Thus, the headphone module according to an embodiment of the present invention can be widely applied to headphone products. Furthermore, through the audio cavity adjustment member, the diaphragm has better transient characteristics and high sensitivity.

The headphones according to an embodiment of the present invention have several advantages and beneficial effects. For example, the main body of the sounding module is formed with the first and second auxiliary air holes. The earphone casing comprises the annular partition therein. The annular partition partitions the conventional rear cavity into a first rear cavity and a second rear cavity, such that most bass enters the second rear cavity through the second auxiliary holes. Most of low-frequency signals are clearly separated to provide a better frequency division effect and to improve the bass effect and the audio quality of the earphone. The present invention can effectively solve the problem that all low-frequency signals, intermediate-frequency signals and high-frequency signals of the prior art are mixed in the rear cavity to cause a worse bass effect. The headphone according to an embodiment of the present invention meets the requirements for a bass effect.

In addition, the headphones according to another embodiment of the present invention include first and second auxiliary air holes. The second auxiliary air holes accomplish frequency division of low-frequency signals. The first auxiliary air holes are disposed in front of the second auxiliary air holes to retain and enhance intermediate-frequency signals effectively, in particular high-frequency signals, to adjust and improve tri-frequency balance and to improve the audio quality of the earphone.

Further, the headphone module according to an embodiment of the present invention is beneficial for production and assembly. Thus, the headphone module can be widely applied to headphone products. Furthermore, through the audio cavity adjustment member, the diaphragm has better transient characteristics and high sensitivity.

It will be apparent to those skilled in the art that various modifications and variations can be made in the headphone and the headset of embodiments of the invention without departing from the spirit or scope of the invention. Thus, it is intended that embodiments of the invention cover the modifications and variations of this invention provided they come within the scope of the appended claims and their equivalents.

What is claimed:

1. A headphone device, comprising:

a housing, the housing including a first chamber, a second chamber, a first through-hole, wherein the first chamber and the second chamber are separated by a first wall, and the first through-hole is in the first wall;

a loudspeaker assembly in the housing, the loudspeaker assembly including a yoke, a magnet, a washer, a voice coil, and a diaphragm, wherein the yoke, the magnet, the washer, and the voice coil are positioned corresponding to the first through-hole, the diaphragm being connected on the voice coil in the first chamber;

a first annular portion in the housing, wherein the first annular portion including a first auxiliary hole and a second auxiliary hole, each of the first auxiliary hole and the second auxiliary hole overlapping a portion of the first through-hole, wherein the first auxiliary hole is covered with a first sound-proof material and the second auxiliary hole is covered with a second sound-proof material and wherein the first sound-proof material filters a first frequency range and the second sound-proof material filters a second frequency range, the first frequency range being substantially different from the second frequency range.

2. The device according to claim 1, wherein the first auxiliary hole is substantially concentric to the first through-hole.

3. The device according to claim 1, wherein at least some of the frequency in the first frequency range are higher than the second frequency range.

4. The device according to claim 1, wherein both the first auxiliary hole and the second auxiliary hole provide air passage from the first chamber into the second chamber and exiting from the second chamber to the first chamber.

5. The device according to claim 1, further comprising more than one of second auxiliary holes.

6. The device according to claim 5, the second auxiliary holes provide air passage next to the first auxiliary hole.

7. The device according to claim 1, wherein the housing further includes a first opening in the first chamber, the first opening located on an opposing side of the first chamber from the first through-hole, and wherein the diaphragm is located corresponding to the first opening in the first chamber.

8. The device according to claim 7, wherein the housing further includes a second opening in the first chamber, the second opening located next to the first opening.

9. The device according to claim 1, wherein the first annular portion further includes a third auxiliary hole on a side wall filtering a third frequency range, the third frequency range being substantially different from the first frequency range or the second frequency range.

10. The device according to claim 9, wherein at least some of the frequency in the third frequency range are lower than the first frequency range or the second frequency range.

11. The device according to claim 9, wherein the third auxiliary hole provides air passage into the first chamber.

12. The device according to claim 9, wherein the housing further includes a first opening and a second opening in the first chamber, the first opening and the second opening located on an opposing side of the first chamber from the first through-hole, and wherein the diaphragm is located corresponding to the first opening in the first chamber.

13. The device according to claim 12, wherein the third auxiliary hole provides air passage into the first chamber and exiting the first chamber through the second opening.

14. The device according to claim 9, further comprising more than one of second auxiliary holes.

* * * * *